US005131475A

United States Patent [19]

Beney

[11] Patent Number: 5,131,475

[45] Date of Patent: Jul. 21, 1992

[54] SYSTEM FOR CONTROLLING DRILLING FORCE OF A TELESCOPING ROCK DRILL

[75] Inventor: Gilbert Beney, Meyzieu, France

[73] Assignee: Secoma S.A., Meyzieu, France

[21] Appl. No.: 757,702

[22] Filed: Sep. 11, 1991

[30] Foreign Application Priority Data

Sep. 20, 1990 [FR] France ..... 90 12210

[51] Int. Cl.[5] ..... E21B 44/00

[52] U.S. Cl. ..... 173/1; 173/4; 173/11; 173/19; 175/27

[58] Field of Search ..... 173/1, 4, 11, 19, 13, 173/32, 105, 163; 175/27

[56] References Cited

U.S. PATENT DOCUMENTS

| | | | |
|---|---|---|---|
| 3,823,784 | 7/1974 | Feucht | 173/1 |
| 3,880,244 | 4/1975 | Boom et al. | 173/19 |
| 4,113,033 | 9/1978 | Lindblad | 173/4 |
| 4,246,973 | 1/1981 | Mayer | 173/11 |
| 4,503,918 | 3/1985 | Bergkvist et al. | 175/27 |
| 4,537,263 | 8/1985 | Bjor | 173/1 |
| 4,848,485 | 7/1989 | Piipponnen et al. | 175/27 |

*Primary Examiner*—Frank T. Yost

*Assistant Examiner*—Scott A. Smith

*Attorney, Agent, or Firm*—Herbert Dubno; Andrew Wilford

[57] ABSTRACT

A telescoping drill has a base, a guideway displaceable longitudinally forwardly and rearwardly on the base, a guideway actuator braced between the guideway and the base and energizable for longitudinal forward displacement of the guideway on the base, a guideway source of energy connected to the guideway actuator for longitudinally forwardly displacing the guideway on the base, a drill carriage displaceable longitudinally on the guideway between a front position and a rear position, a drill actuator braced between the drill carriage and the guideway for longitudinal forward displacement of the carriage on the guideway, and a drill source of energy independent of the guideway energy source and connected to the drill actuator for longitudinally forwardly displacing the drill carriage on the guideway. A sensor detects when the drill carriage is in the rear position. A controller is connected between the sensor and the guideway source for arresting forward displacement of the guideway on the base when the drill carriage is in the rear position.

9 Claims, 1 Drawing Sheet

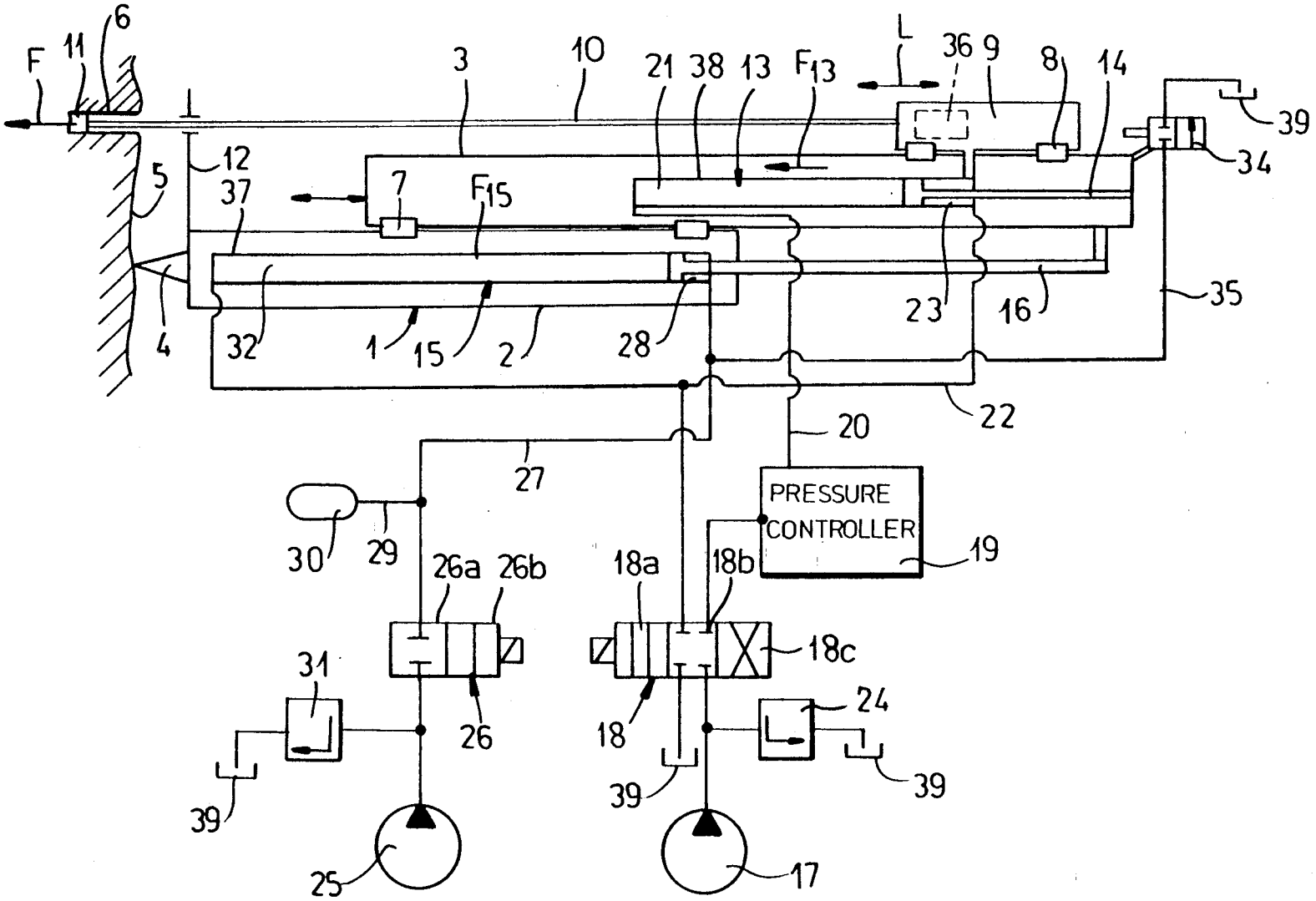
PRESSURE CONTROLLER

SYSTEM FOR CONTROLLING DRILLING FORCE OF A TELESCOPING ROCK DRILL

FIELD OF THE INVENTION

The present invention relates to a telescoping rock drill. More particularly this invention concerns a method of and apparatus for controlling the force such a drill applies as it operates.

BACKGROUND OF THE INVENTION

A standard telescoping rock drill comprises a base, a guideway displaceable longitudinally forwardly and rearwardly on the base, a guideway actuator braced between the guideway and the base and energizable for longitudinal forward displacement of the guideway on the base between front and rear positions, a drill carriage displaceable longitudinally on the guideway between a front position and a rear position, and a drill actuator braced between the drill carriage and the guideway for longitudinal forward displacement of the carriage on the guideway. As described in C. Boom U.S. Pat. No. 3,880,244 and K. Fujukawa U.S. Pat. No. 3,356,871 various limit switches are provided to back out the drill once it reaches a full-forward position, that is with both the drill carriage and the guideway in full-forward positions on the guideway and base, respectively.

In such an arrangement the force exerted longitudinally forward by the drill on the face is a function of several factors, namely the force exerted by the drill actuator, the force of the guideway actuator, the friction between the drill carriage and the guideway, the friction between the guideway and the base, the masses of the drill and of the guideway, and the angle the drill is set at relative to the horizontal. The drilling force effective on the drill bit when only the drill actuator is being used to advance it is a function of the force exerted by the drill actuator, less the force lost to friction between the drill carriage and the guideway, adjusted for the angle the drill forms to the horizontal. The telescoping force when only the guideway actuator is being used is a function of the actuator force less the losses to friction between the guideway and the base adjusted for the angle the drill forms to the horizontal which in turn is a function of guideway and drill mass.

The result is that the force the drill bit exerts on the face can vary within a wide range, even when the various actuators are pressurized always at the same levels. When drilling uphill, that is with the rear end of the drill bit below the front end, there is a substantial loss in drilling efficiency and an increased likelihood of damaging the drill bit, as well as the possibility of hammering on emptiness, which can also break the bit tip. When drilling downhill the drilling force is uncontrolledly augmented so that the bit can overheat and break, and the hole can move readily off line. In general it is difficult to calculate at any time just what the drilling force will be because it is a function of so many variables and the automatic switching between operation of the guideway and drill actuators further complicates the equation.

OBJECTS OF THE INVENTION

It is therefore an object of the present invention to provide an improved rock drill.

Another object is the provision of such an improved rock drill which overcomes the above-given disadvantages, that is which can be operated to ensure constant drilling force regardless of whether the bit is being advanced by the drill or guideway actuator.

SUMMARY OF THE INVENTION

A telescoping drill has a base, a guideway displaceable longitudinally forwardly and rearwardly on the base, a guideway actuator braced between the guideway and the base and energizable for longitudinal forward displacement of the guideway on the base, a guideway source of energy connected to the guideway actuator for longitudinally forwardly displacing the guideway on the base, a drill carriage displaceable longitudinally on the guideway between a front position and a rear position, a drill actuator braced between the drill carriage and the guideway for longitudinal forward displacement of the carriage on the guideway, and a drill source of energy independent of the guideway energy source and connected to the drill actuator for longitudinally forwardly displacing the drill carriage on the guideway. A sensor detects when the drill carriage is in the rear position. A controller is connected between the sensor means and the guideway source for arresting forward displacement of the guideway on the base when the drill carriage is in the rear position.

Thus with this system the telescoping movement, which is solely the function of the guideway actuator, serves merely to position the actuator but the actual force applied by the drill bit against the face is purely the work of the drill actuator. In other words the guideway actuator, which normally is moved with a force much greater than that of the drill carriage, serves only to reposition the guideway. This is best done by ensuring that, once the guideway is positioned, it is prevented from moving backward, for instance by blocking outflow of any hydraulic fluid from its chamber responsible for forward movement.

According to the invention the actuators are hydraulic rams and the sources are pumps and the sensor means is a valve openable by the carriage in its rear position to depressurize the guideway-source ram. The drill source includes a pressure controller connected between the drill-actuator ram and the drill-source pump. This pressure controller is a pressure limiter. In addition includes means for delaying pressurization of the guideway-source ram in the form of an oil/pneumatic accumulator.

The method of this invention therefore comprises the steps of independently energizing the actuators so that same can be operated independently of each other, detecting when the drill carriage is in the rear position, and arresting forward displacement of the guideway on the base when the drill carriage is detected in the rear position. The guideway actuator urges the guideway forward with a predetermined force and the drill actuator urges the drill forward with a substantially smaller force. In addition backward movement of the guideway during forward movement of the drill is inhibited.

BRIEF DESCRIPTION OF THE DRAWING

The above and other objects, features, and advantages will become more readily apparent from the following, reference being made to the accompanying drawing whose sole figure is a largely schematic and diagrammatic illustration of this invention.

SPECIFIC DESCRIPTION

As seen in the drawing a rock drill 1 according to this invention has a base or main support 2 normally mounted on the outer end of an unillustrated tractor-mounted arm and carrying a guideway or secondary support 3 via guides 7. The base 1 has a point part 4 that is normally pressed against a rock face 5 into which a hole 6 is to be drilled in a longitudinal direction L. Guides 8 support a drill carriage 9 atop the guideway 3 for movement also in the direction L. This carriage 9 houses a motor 36 that can rotate a drill rod 10 having a bit end 11 about a longitudinal axis to drill the bore 6.

An actuator 15 has a cylinder 37 fixed in the base 1 and a piston rod 16 that is connected to the guideway 3. This actuator 15 has a front compartment 32 that is pressurizable to move the guideway 3 longitudinally back (toward the right in the drawing) and a rear compartment 28 that is pressurizable to move the guideway 3 longitudinally forward (toward the left in the drawing). Another actuator 13 has a piston rod 14 fixed to the guideway 3 and a cylinder 38 connected to the carriage 8. This actuator 13 has a front compartment 21 pressurizable to move the carriage 9 longitudinally forward and a rear compartment 23 pressurizable to move it longitudinally back.

The carriage actuator 13 can be pressurized to move the drill carriage 9 on the guideway 3 by a pump 17 connected through a three-position slide valve 18, a pressure controller 19, and a conduit 19 to the front compartment 21 and also via a line 22 and the valve 18 to a sump 39. A pressure-limiting valve 24 connected immediately downstream of the output of the pump 17 limits its maximum pressure. The valve 18 has a section **18*a* for straight through connection, a central section 18*b* for no connection of the lines 20 and 22, and a section 18*c* for reverse connection and retraction of the drill rod 10**.

The guideway actuator 15 can be pressurized to move the guideway 3 on the base 1 by means of a pump 25 connected through a two-position valve 26 and a conduit 27 to the rear compartment 28. The valve 26 has a section **26*a* that blocks flow from the pump 25 to the line 27 and a section 26*b* permitting such flow. A branch line 29 from the conduit 27 is connected to an oil/pneumatic accumulator 30** acting as a delay device.

In addition a valve 34 mounted on the guideway 3 is connected between the sump 39 and a line 35 connected to the feed line 27 and is operated when the drill 9 is in its rearmost position to make this connection and, therefore, depressurize the compartment 28.

The system described above operates as follows:

To start with both valves 18 and 26 are opened. This connects the lines 20 and 27 to the respective pumps 17 and 25 and the line 22 to the sum 39. Immediately the cylinder 38 will be drawn forward in the guideway 3 with the drill 9, advancing the latter toward the face 5 and, if necessary, closing the valve 34. Meanwhile the buffer/accumulator 30 will pressurize and, once it has pressurized substantially, pressure will build up in the compartment 28 and the guideway 3 will be telescoped forward.

The force $F_{15}$ applied in the forward direction by the pressure in the chamber 28 of the actuator is substantially greater than the pressure $F_{13}$ exerted in the forward direction by pressure in the compartment 21 of the actuator 13 so that the drill 9 will be forced back until it abuts the valve 34, which action depressurizes the chamber 28 and causes the drill 9 to advance on its own until it has pulled off the valve 34 and restarted telescoping of the guideway 3.

This alternate advance of the guideway 3 and drill 9 will take place until the guideway 3 is in its full forward position and thereafter drilling will be effected by the actuator 13 only as in standard prior-art systems. In any case the pressure exerted longitudinally forward will be determined solely by the pressure in the compartment 21; the force exerted by the actuator 15 is not relevant to the pressure the bit end 11 exerts forward on the face 5 since even during advance of the guideway 3 the effective pressure on the bit 11 is basically the force $F_{13}$.

The controller 19 can be a simple pressure limiter. It can also be more complicated to have other functions and can be connected to different hydraulic and/or electronic control systems, for instance for progressive drilling, limiting the hammering pressure in accordance with the drilling force, unsticking a jammed bit, and so on.

The invention basically resides in the separation of the functions of telescoping, that is advancing the guideway 3 on the base 2, and of drilling, that is advancing the drill 9 on the guideway 3. The telescoping takes place regardless of circumstances to ensure that the full travel of the drill is exploited, while the pressure applied at the drill bit is carefully controlled by the actuator 13.

Certain variants lie within the scope of the invention. For instance either actuator 13 or 15 can be connected to the respective elements by a cable or chain. Similarly a rotary motor or other actuator could replace the illustrated hydraulic rams. The valve 34 could be replaced by some other end switch or limiting device which could work wholly mechanically or electronically. The accumulator could be replaced by another system ensuring a delay of pressurization of the line 27 after the line 20. If the actuators were changed to electrical or pneumatic devices, they would be energized by appropriate sources of electrical or pneumatic energy, not by hydraulic pumps as shown.

I claim:

1. A telescoping drill comprising:

a base;

a guideway displaceable longitudinally forwardly and rearwardly on the base;

a guideway actuator braced between the guideway and the base and energizable for longitudinal forward displacement of the guideway on the base;

means including a guideway source of energy connected to the guideway actuator for longitudinally forwardly displacing the guideway on the base;

a drill carriage displaceable longitudinally on the guideway between a front position and a rear position;

a drill actuator braced between the drill carriage and the guideway for longitudinal forward displacement of the carriage on the guideway;

means including a drill source of energy independent of the guideway energy source and connected to the drill actuator for longitudinally forwardly displacing the drill carriage on the guideway;

sensor means for detecting when the drill carriage is in the rear position; and control means connected between the sensor means and the guideway source for arresting forward displacement of the guideway on the base when the drill carriage is in the rear position.

2. The telescoping drill defined in claim 1 wherein the actuators are hydraulic rams and the sources are pumps and the sensor means is a valve openable by the carriage in its rear position to depressurize the guideway-source ram.

3. The telescoping drill defined in claim 2 wherein the drill source includes a pressure controller connected between the drill-actuator ram and the drill-source pump.

4. The telescoping drill defined in claim 2 wherein the pressure controller is a pressure limiter.

5. The telescoping drill defined in claim 2 wherein the guideway source includes means for delaying pressurization of the guideway-source ram.

6. The telescoping drill defined in claim 4 wherein the delay means is an oil/pneumatic accumulator.

7. A method of operating a telescoping drill having:

a base;

a guideway displaceable longitudinally forwardly and rearwardly on the base;

a guideway actuator braced between the guideway and the base and energizable for longitudinal forward displacement of the guideway on the base;

a drill carriage displaceable longitudinally on the guideway between a front position and a rear position; and a drill actuator braced between the drill carriage and the guideway for longitudinal forward displacement of the carriage on the guideway; the method comprising the steps of:

independently energizing the actuators, whereby same can be operated independently of each other;

detecting when the drill carriage is in the rear position; and arresting forward displacement of the guideway on the base when the drill carriage is detected in the rear position.

8. The drill-operating method defined in claim 1 wherein the guideway actuator urges the guideway forward with a predetermined force and the drill actuator urges the drill forward with a substantially smaller force.

9. The drill-operating method defined in claim 8, further comprising the step of inhibiting backward movement of the guideway during forward movement of the drill.

* * * * *